United States Patent [19]

Fu et al.

[11] 4,312,604

[45] Jan. 26, 1982

[54] FRICTION ROCK STABILIZER SET, AND A METHOD OF FIXING A FRICTION ROCK STABILIZER IN AN EARTH STRUCTURE BORE

[75] Inventors: Chuen-Cheng Fu, North Brunswick; Satya P. Arya, Somerville, both of N.J.

[73] Assignee: Ingersoll-Rand Co., Woodcliff Lake, N.J.

[21] Appl. No.: 169,817

[22] Filed: Jul. 17, 1980

[51] Int. Cl.[3] ..... E21D 21/00; E21D 20/00

[52] U.S. Cl. ..... 405/259; 411/60

[58] Field of Search ..... 405/259–261, 405/244; 411/24–28, 77–80, 44–54, 57–62

[56] References Cited

U.S. PATENT DOCUMENTS

| | | | |
|---|---|---|---|
| 710,534 | 10/1902 | Steward | 411/25 |
| 729,124 | 5/1903 | Boone | 411/24 |
| 1,000,715 | 8/1911 | Caywood | 411/60 |
| 1,025,275 | 5/1912 | Kennedy | 411/63 |
| 2,443,466 | 6/1948 | Lord | 411/45 |
| 3,808,938 | 5/1974 | Chrony | 411/57 |
| 4,109,556 | 8/1978 | Vollmer et al. | 411/57 |

FOREIGN PATENT DOCUMENTS

| | | | |
|---|---|---|---|
| 524073 | 11/1953 | Belgium | 411/44 |
| 2435152 | 2/1976 | Fed. Rep. of Germany | 411/44 |
| 2652630 | 5/1978 | Fed. Rep. of Germany | 411/44 |
| 897568 | 5/1944 | France | 411/24 |
| 1169799 | 11/1969 | United Kingdom | 411/54 |

*Primary Examiner*—Dennis L. Taylor

*Attorney, Agent, or Firm*—David W. Tibbott; Bernard J. Murphy

[57] ABSTRACT

Broadly, the invention comprises defining a friction rock stabilizer with a configuration which will allow its insertion into an earth structure bore with minimal thrust force, and then deforming the inserted stabilizer, for instance, by forcing an insert thereinto to cause radial expansion of the stabilizer to increase its frictional engagement with the bore surface and produce a high anchorage thereof. The stabilizer set of the invention comprises a stabilizer and at least one oversized expansion insert therefore.

15 Claims, 13 Drawing Figures

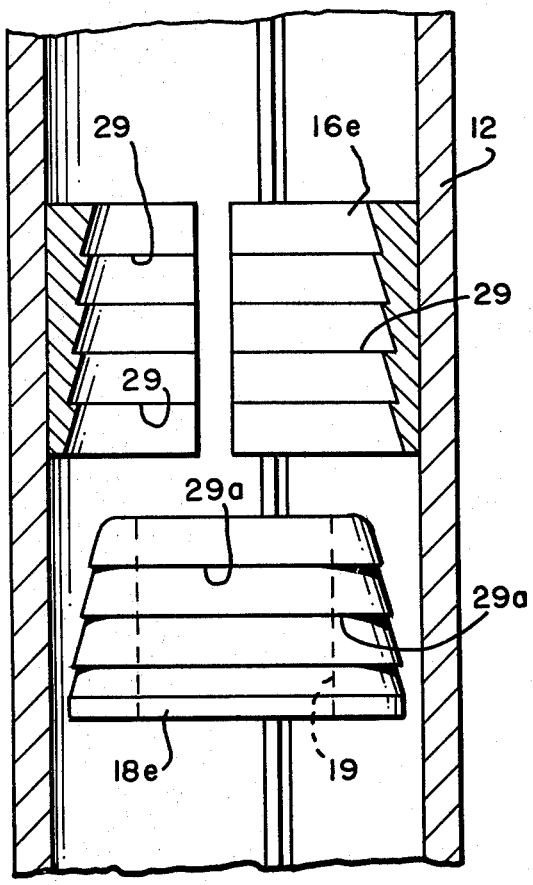
FIG. 6
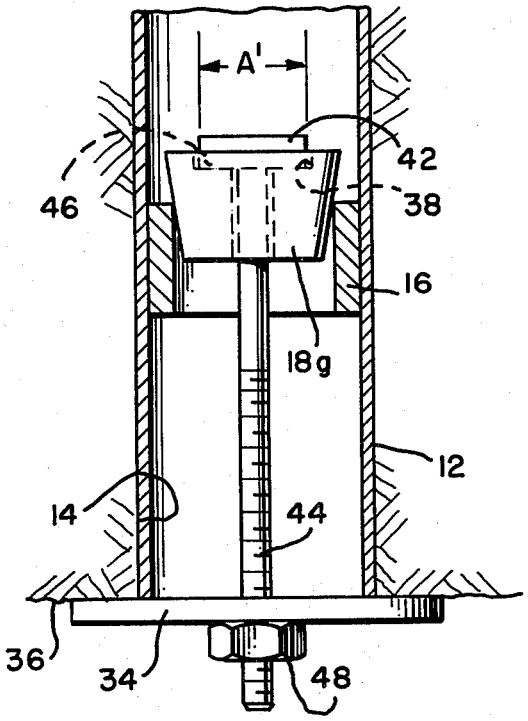
FIG. 10
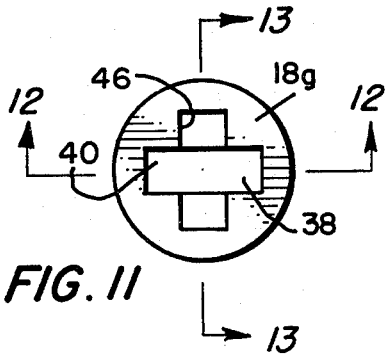
FIG. 11
FIG. 13
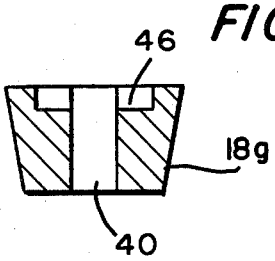
FIG. 12
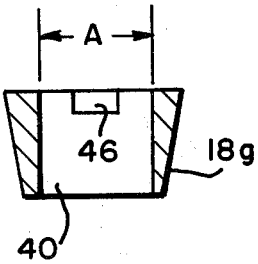

FRICTION ROCK STABILIZER SET, AND A METHOD OF FIXING A FRICTION ROCK STABILIZER IN AN EARTH STRUCTURE BORE

This invention pertains to friction rock stabilizers, and to methods of fixing them in earth structure bores, and in particular to a novel method of inserting and fixing such stabilizers in earth structure bores with minimal thrust forces, albeit yielding high anchor loads therefore.

U.S. Pat. Nos. 3,922,867, issued on Dec. 2, 1975, and 4,012,913, issued on Mar. 22, 1977, both to James J. Scott, and both for "Friction Rock Stabilizers", are exemplary of the stabilizers to which the invention pertains. Such stabilizers comprise hollow bodies having substantially uniform inside diameters; additionally, they have means, such as an axially-extending slot, to facilitate contraction thereof.

Friction rock stabilizers are not readily susceptible of use in coal mines because state-of-the-art rotary roof bolters lack sufficient thrust force to push the stabilizers into the required anchor load. Impacting hammers, and various other modifications to rotary roof bolters, are being developed to enable insertion of stabilizers into mine bores, but market exploitation of the stabilizers would be greatly facilitated if existing, unmodified roof bolters could be used for their insertion. In general, the maximum thrust force which can be gotten from a roof bolter in poor condition is about 5,000 to 6,000 pounds. A friction rock stabilizer, however, requires an average of 10,000 pounds of thrust for full insertion.

It is an object of this invention to set forth a method of stabilizer insertion which will yield high anchor loads with only about half as much insertion force as is required in prior art insertion methods.

It is particularly an object of this invention to teach a method of fixing an elongate friction rock stabilizer in an earth structure bore of a given, transverse dimension, comprising the steps of inserting an elongate friction rock stabilizer in an earth structure bore; and expanding the inserted stabilizer, into fast frictional engagement with the bore surface, by forcing an insert internally and lengthwise of the stabilizer.

Further objects of this invention, as well as the novel features thereof, will become more apparent by reference to the following description, taken in conjunction with the accompanying figures, in which:

FIGS. 4, 5, 6 and 7 are similar to FIG. 3, but show still further embodiments of the invention;

FIG. 10 is an elevational view, similar to those of FIGS. 3–7, of a further embodiment of the invention;

FIG. 11 is a plan or top view of the insert of the FIG. 10 embodiment; and FIGS. 12 and 13 are cross-sectional views taken along sections 12—12 and 13—13, respectively, of FIG. 11.

Figure 2:
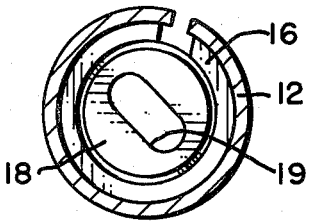
FIG. 2 is a cross-sectional view taken along Section 2—2 of FIG. 1.
Figure 1:
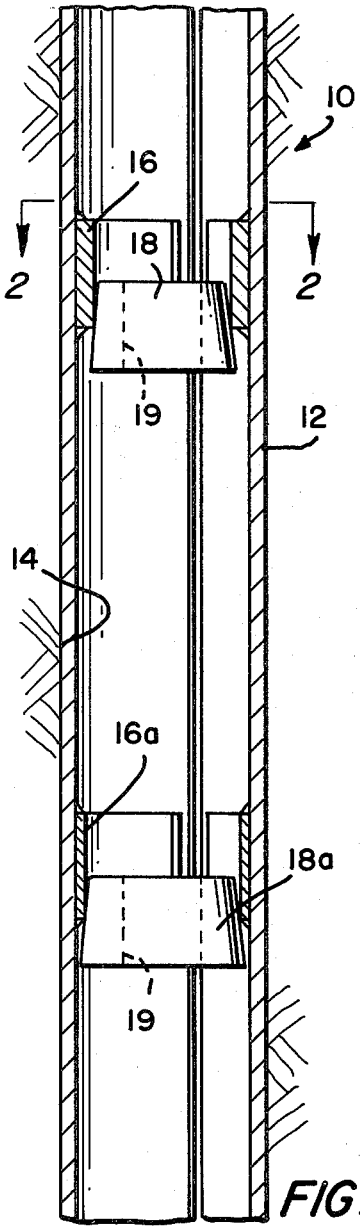
FIG. 1 is an elevational view, in cross-section, of a portion of a friction rock stabilizer in an earth structure bore prior to being expanded by inserts, according to an embodiment of the invention.

As shown in FIG. 1, the novel method, in a first embodiment 10, comprises the use of an inexpensive, expendable insert to expand the hollow friction rock stabilizer 12 tightly against the wall of a drilled hole 14 in the mine roof. The stabilizer 12 has a substantially uniform inside diameter. However, in the practice of this method of fixing a friction rock stabilizer 12 in a bore, first, the stabilizer is formed with one or more inner, substantially annular lands 16 and 16*a*. It is fixed in place in the predrilled hole 14 in the mine roof. Next, oversized inserts 18 and 18*a* are forced into the stabilizer 12, into engagement with the lands, expanding the stabilizer 12 against the wall of the drill hole 14. The forced engagement of the inserts 18 and 18*a* with the lands 16 and 16*a* results in an expansion which is sufficient to cause the stabilizer 12 to hold fast against the wall. A blade-ended and flanged or shouldered push rod (not shown), which forces the inserts through the stabilizer 12, is extracted; it has only a slidingfit engagement with a rod-receiving aperture 19 formed in the inserts 18 and 18*a*. The apertures 19, of course, are provided to allow the leading end blade or tongue of the push rod to engage therewith, with the flange or shoulder of the rod engaging the under surface of the inserts. The lands 16 and 16*a* are welded in place before the stabilizer 12 has been formed into its tubular shape. Typically, only one land 16 or 16*a* and only one insert 18 or 18*a* will be sufficient to expand the stabilizer into adequate, gripping engagement with the hole 14. Especially is this so where the stabilizer is not of significant length, and has a free, outside diameter larger than the dimension of hole 14 and, as a consequence, has been pressed into the hole with a force of two and a half tons or so. Then, with one land 16, and one oversized insert 18 forced into the stabilizer—again with two and a half tons of force—the combination will result in a five ton anchorage for the stabilizer.

If the stabilizer 12 is of considerable length then such stabilizer should have at least two lands 16 and 16*a* and two inserts 18 and 18*a* therefore. Too, the relative dimensions of the latter have to be different. As shown in FIG. 1, land 16 has a fair thickness, and insert 18 is of moderate diameters. Land 16*a*, however, is quite thin, and insert 18*a* is of greater diameters. Thus, insert 18 is freely passed through land 16*a* to come into forced engagement with land 16, and insert 18*a* is properly dimensioned to engage land 16*a*. Insert 18, then, is first pressed into place, and insert 18*a* is installed next.

Figure 3:
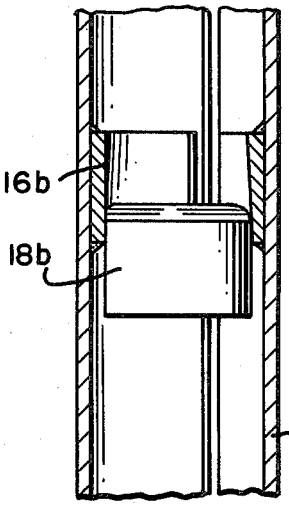
FIG. 3 is another elevational view, in cross-section, of a portion of a friction rock stabilizer in an earth structure bore prior to be expanded by an insert, according to an alternative embodiment of the invention.

Inserts 18 and 18*a* are of tapered configuration, and the lands 16 and 16*a* are straight-sided. Now, as shown in FIG. 3, this may be reversed. In this latter embodiment, the land 16*b* is tapered, and the insert 18*b* is straight-sided.

As illustrated and described thus far, the method contemplates bringing inserts to the borehole installation for insertion into the stabilizer 12. Alternatively the stabilizers can be shipped to the mine site with the expanding inserts captive therewithin. Such an arrangement is possible with the embodiments shown in FIGS. 4 and 5.

Figure 4:
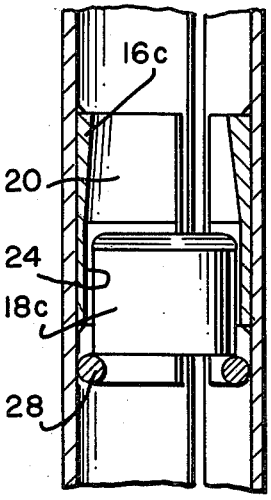
Figure 5:
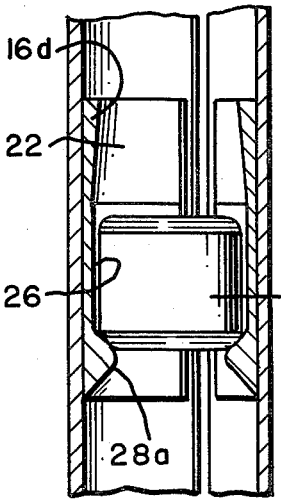

In FIGS. 4 and 5, lands 16*c* and 16*d* have tapering surfaces 20 and 22 for frictionally engaging the respective inserts 18*c* and 18*d*, and reduced-thickness portions 24 and 26 in which to nest the inserts. Below land 16*c*, however, is a split annulus 28, welded to the inside of the stabilizer 12, which serves as a keeper for the insert 18*c*. Before shipment of the stabilizer 12 from the manufacturer, the insert 18*c* is forced past the annulus 28, securely to be retained (until it is addressed with a push rod into engagement with surface 20). Land 16*d* (FIG. 5) comprises its own keeper 18*a*, the latter being a prominent, lower portion contiguous with surface 26.

Possibly, in some earth environments subject to significant ground movement, the embodiments of FIGS. 1–5, which employ the inventive method, may be inadequate. If the insert and land surfaces thereof are too smooth, and ground planes shift, the inserts may slip downwardly and allow the stabilizer 12 to contract. In such circumstances, the embodiment of FIG. 6, or that of FIGS. 7 and 8 shall have to be employed.

In FIG. 6, the land 16*e* is formed with a plurality of successive, stepped ridges 29, and the insert 18*e* also has complementary ridges 29*a*, one or more of which, on insertion, lock with one or more of the ridges 29.

Figure 7:
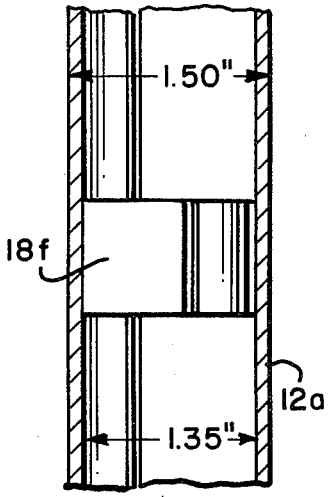
Figure 8:
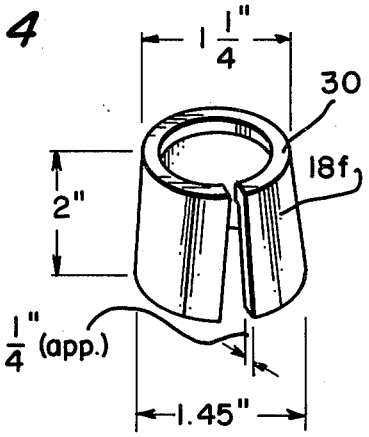
FIG. 8 is a perspective view of the insert used in the embodiment of FIG. 7.
Figure 9:
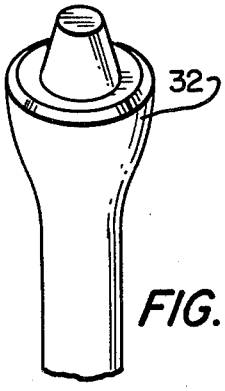
FIG. 9 is a perspective view of the working end of a tool used for installing the FIG. 8 insert.

FIGS. 7–9 disclose the principal elements used in an alternative and preferred practice of the invention. Here, no lands are required the stabilizer 12*a* is like those set forth in priorly-cited U.S. Pat. No. 3,922,867. It comprises a hollow body having a substantially uniform inside diameter. An oversized, split insert 18*f* is used to engage the inside surface of the stabilizer 12*a*. Insert 18*f* is of a generally frustoconical shape, having a circumferential bearing surface 30 for engagement thereof by an insertion tool 32.

Stabilizer 12*a* is forced into a one and a half inch bore, with approximately a two and a half ton force, and thereafter the insert 18*f*, by means of tool 32, is forced into the bore-installed stabilizer 12*a* with a same approximate two and a half ton force.

As shown in FIG. 8, a preferred embodiment of the insert 18*f*, for the standard, commercially distributed stabilizers, is of tapered or frusto-conical configuration, having free, outermost dimensions of one and a quarter inch and one and forty-five hundreds inch, and a length of two inches. When pressed into a bore-installed stabilizer 12*a*, the larger outside diameter of the insert 18*f* is reduced, and the smaller outside diameter expands, to the bore-installed i.d. of the stabilizer: one and thirty-five hundreds of an inch. As with the inserts of FIGS. 1–6, this practice with insert 18*f* results in an average fiveton anchorage for the stabilizer 12*a*.

The invention, according to our teachings, requires no complicated mandrel withdrawing techniques, does not disturb the stabilizer 12 or 12*a* once it is in place, and requires only expendable inserts 18 and 18*a* through 18*f* which can be made inexpensively.

We are aware of a somewhat similar, prior art practice, notably the U. S. Pat. No. 3,349,567, issued to J. E. Munn, on Oct. 31, 1967, for a "Mine Roof Support and Method of Providing Same". However, our novel method is clearly distinguished over these teachings.

Patentee Munn sets forth the use of a metal tube; the latter is "slidably fitted into the hole" and, by a process of "pulsed magnetic metal forming", creates one, two, or more localized, expanded bulges in the tube. Whatever the merits of this teaching, it has an inherent disadvantage. The bulge (or bulges) create localized stresses in the rock adjacent thereto—as does a top anchor in a conventional roof bolt—and the tube metal, between the bulges, has no frictional, stabilizing engagement with the rock. The remarkable benefit of the friction rock stabilizer is its fast engagement with the rock substantially fully along the whole length thereof, and its total lack of local stress points. Applicants' invention improves over the Munn teaching, while retaining the inherent simplicity of the basic friction rock stabilizer, by the use of inserts which cause the tubular stabilizer to expand, radially, along the length thereof. No localized stresses arise from Applicants' method.

Conventionally, friction rock stabilizers receive a roof plate at the lower, exposed end thereof, to engage the face of the bored roof. It is an ancillary teaching of our invention to employ the stabilizer inserts as anchors for the roof plates. FIGS. 10—13 illustrate this latter practice.

As shown in FIGS. 10—13, a stabilizer 12, having an inner land 16 therein, confines therewithin a loose-fitting insert 18*g*. According to the foregoing disclosure, it is intended that insert 18*g* shall be forced downwardly into land 16 to cause radial expansion of the stabilizer. In order to secure a roof plate 34 in place, however, the "tool" which is used to forceably position the insert 18*g* is retained and used to fix the plate 34 fast against the face 36.

Insert 18*g* has an aperture 38 formed therein which comprises a first, through-going passage 40 of a width "A" which is greater than the width "$A^1$" of the head 42 of a T-headed, threaded rod 44. Transverse to passage 40 is formed an "A"-width recess 46 in which to freely nest the head 42 of rod 44. Following installation of the stabilizer 12, the rod 44 is passed, head-end first, through the passage 40, rotated ninety degrees of arc, and allowed to nest in the recess 46. The plate 34 is emplaced, and a nut 48 is threaded onto the rod end. Next, the nut 48 is torqued up tightly against the plate 34 which, resultantly, forces the insert 18*g* into the land 16, to expand the stabilizer 12, and fixes the plate 34 firmly against the face 36.

As will be evident from the foregoing, a friction rock stabilizer set, according to the invention, comprises a stabilizer 12 or 12*a*, having a given inside diameter, and at least one insert 18, 18*a* . . . 18*g*, having an outside diameter which is greater than the given diameter, for forced movement of the insert internally and lengthwise of the stabilizer to cause radial expansion of the latter.

While we have described our invention in connection with specific embodiments and methods of practice therewith, it is to be clearly understood that this is done only by way of example and not as a limitation to the scope of our invention as set forth on the objects thereof and in the appended claims.

We claim:

1. A method of fixing a hollow body, friction rock stabilizer, having a substantially uniform inside diameter, in an earth structure bore of a given transverse dimension, comprising the steps of:

inserting a friction rock stabilizer in an earth structure bore; and expanding the inserted stabilizer, into fast, frictional engagement with the bore surface, by forcing an insert internally and lengthwise of the stabilizer; wherein said expanding step comprises forcing a contractible insert into the stabilizer.

2. A method, according to claim 1, further including the step of:

forming the friction rock stabilizer, which is to be inserted into a given earth structure bore of a prescribed diameter, with a greatest transverse dimension which is smaller than said prescribed diameter.

3. A method, according to claim 1, wherein:

said expanding step comprises forcing a plurality of inserts into the stabilizer; and said forcing step comprises forcing the inserts of said plurality thereof through the stabilizer from one end of the latter toward the end opposite, and leaving the inserts within the stabilizer.

4. A method, according to claim 3, wherein:

said forcing step further comprises forcing each of the inserts through the stabilizer, with a push rod, to discrete positions therewithin; and withdrawing the push rod upon the inserts having reached said discrete positions.

5. A method, according to claim 1, further including the step of:

forming the friction rock stabilizer, which is to be inserted into a given earth structure bore of a prescribed diameter, with a greatest transverse dimension which is substantially equal to said prescribed diameter.

6. A method, according to claim 1, wherein:

said forcing step comprises forcing into the stabilizer an insert having free, outside diameters which are smaller and larger than is the stabilizer inside diameter following bore-insertion thereof.

7. A method, according to claim 6, further including:

forming the stabilizer of such material, configuration, and outside dimension, as to require not more than approximately two and a half tons of insertion force to fix said stabilizer in a bore of said given transverse dimension; and forming the stabilizer inside diameter of such a dimension, and the contractible insert of such material, configuration, and outside dimension as to require not more than approximately two and a half tons of insertion force to force said insert into the stabilizer following bore-insertion of said stabilizer.

8. A method, according to claim 6, wherein:

said forcing step comprises forcing into the stabilizer, following bore-insertion thereof, an insert having a free, outside diameter which is approximately 1.075 times larger than said inside diameter.

9. A method, according to claim 6, wherein:

said forcing step comprises forcing into the stabilizer, following bore-insertion thereof, an insert having at least a portion thereof which must contract to approximately 93 percent of its free dimension to accommodate entry thereof into the stabilizer.

10. A friction rock stabilizer set, comprising:

a hollow body, friction rock stabilizer, having a substantially uniform inside diameter; and an oversized, contractible, expansion insert, for forced movement thereof internally and lengthwise of said stabilizer, for radially expanding said stabilizer.

11. A friction rock stabilizer set, according to claim 10, wherein:

said insert has a plurality of outside diameters.

12. A friction rock stabilizer set, according to claim 11, wherein:

said insert is of frusto-conical configuration.

13. A friction rock stabilizer set, according to claim 12, wherein:

said insert is hollow, and has a slot formed therein which extends lengthwise thereof.

14. A method of fixing a friction rock stabilizer in an earth structure bore of a given transverse dimension, comprising the steps of:

inserting a friction rock stabilizer in an earth structure bore; and expanding the inserted stabilizer, into fast, frictional engagement with the bore surface, by forcing separate inserts internally and lengthwise of the stabilizer; further including the step of forming the friction rock stabilizer of substantially one, uniform wall thickness throughout substantially the full length thereof, of a second wall thickness which is greater than said one thickness at a prescribed location along the length thereof and of a third wall thickness, which is greater than said second wall thickness, at a given location along the length thereof; and wherein said forcing step comprises passing a first insert through said second wall thickness and into frictional engagement with the stabilizer at said given location, and forcing a second insert into frictional engagement with the stabilizer at said prescribed location.

15. A method of fixing a friction rock stabilizer in an earth structure bore, comprising the steps of:

inserting a friction rock stabilizer in an earth structure bore; and expanding the inserted stabilizer, into fast, frictional engagement with the bore surface, by forcing an insert internally and lengthwise of the stabilizer; further including the step of forming the friction rock stabilizer of substantially one, uniform wall thickness throughout substantially the full length thereof, and of a second wall thickness which is greater than said one thickness at a prescribed location along the length thereof; wherein said forcing step comprises forcing an insert into frictional engagement with the stabilizer at said prescribed location; and further including the steps of forming the insert with an axial, through-going bore;

passing the headed end of an elongate, headed rod, which has a threaded opposite end, through the insert bore;

engaging an axial end of the insert with the headed-end of the rod;

suspending an apertured plate below the stabilizer by (1) penetrating the apertured plate with the opposite end of the rod, and (2) engaging the opposite end of the rod with a threaded fastener; and forcing the insert and plate towards each other by torquing the fastener tightly on the rod and against the plate.

* * * * *